United States Patent [19]

Kirkland

[11] Patent Number: 4,819,388

[45] Date of Patent: Apr. 11, 1989

[54] SPIN-BLAST TOOL WITH ROTATIONAL VELOCITY RESTRAINT

[76] Inventor: Wyatt S. Kirkland, 1536 Chanticleer Ave., Santa Cruz, Calif. 95062

[21] Appl. No.: 115,991

[22] Filed: Nov. 3, 1987

Related U.S. Application Data

[63] Continuation-in-part of Ser. No. 277,813, Jun. 26, 1987, Pat. No. 4,704,826.

[51] Int. Cl.[4] ..... B24C 3/06

[52] U.S. Cl. ..... 51/411; 51/439; 51/134.5 F; 188/180; 310/103

[58] Field of Search ..... 51/439, 411, 430, 427, 51/134.5; 188/267, 180; 239/252, 256; 242/84.52 B; 310/103, 77, 78, 105

[56] References Cited

U.S. PATENT DOCUMENTS

| | | | |
|---|---|---|---|
| 2,465,932 | 3/1949 | Romine | 242/84.52 B |
| 3,137,974 | 6/1964 | Kirkland | 51/411 |
| 3,488,535 | 1/1970 | Baermann | 310/105 |
| 3,902,276 | 9/1975 | Jarvis | 51/411 |
| 4,163,914 | 8/1979 | Keyes | 310/105 |
| 4,314,427 | 2/1982 | Stolz | 51/411 |
| 4,557,079 | 12/1985 | Sheesley | 51/411 |
| 4,580,742 | 4/1986 | Moosberg | 242/84.52 B |
| 4,601,439 | 7/1986 | Moosberg | 242/84.52 B |
| 4,704,826 | 11/1987 | Kirkland | 51/439 |

FOREIGN PATENT DOCUMENTS

| | | | |
|---|---|---|---|
| 58-117865 | 8/1983 | Japan | 242/84.52 B |
| 0719303 | 12/1954 | United Kingdom | 310/105 |

*Primary Examiner*—Frederick R. Schmidt
*Assistant Examiner*—Robert A. Rose
*Attorney, Agent, or Firm*—Thomas Schneck

[57] ABSTRACT

A pipe spin-blast tool having a tubular handle with inflow and outflow ends. An inner pipe is rotatably mounted to the tubular handle and a jet head is fixed at the end of the inner pipe for rotation therewith. A sand-air mixture is caused to enter the inner pipe through the inflow end of the tubular handle, whereafter the mixture exits the pipe sand-blast tool through angularly aimed nozzles on the jet head. A stationary annular disc and a rotating annular disc are disposed between the jet head and the tubular handle coaxial to the inner pipe. The stationary disc is fixedly mounted to the outflow end of the tubular handle and includes a first set of permanent magnets having coinciding poles aligned parallel with the inner pipe. The rotating disc is mounted to the inner pipe so that it will rotate relative to the stationary disc and has a second set of permanent magnets having coinciding poles oriented opposite the poles of the first set. Thus, the magnets of the first set magnetically attract the magnets of the second set to define a condition of maximum disc stability when the sets of magnets are aligned. The drag which results from forced movement from this condition retards the rotational velocity of the inner pipe. The drag may be varied by axial displacement of the rotating disc relative to the stationary disc.

9 Claims, 2 Drawing Sheets

SPIN-BLAST TOOL WITH ROTATIONAL VELOCITY RESTRAINT

CROSS-REFERENCE TO RELATED APPLICATION

This is a continuation-in-part of application Ser. No. 277,813, filed June 26, 1981 now U.S. Pat. No. 4,704,826.

TECHNICAL FIELD

The invention relates generally to a tool for cleaning the interior of pipes and particularly to a sand blasting tool.

BACKGROUND ART

The interior of metal fluid-conducting conduits, such as those found in gas and oil pipelines, must be cleaned periodically to eliminate the accumulations which build up over time. Typically, the interior wall surface of a pipe is cleaned by use of a blast of sand which is pressurized to impinge the wall surface. To effect uniform cleaning, sandblasting equipment for pipes includes a rotating nozzle member that is moved along the length of a pipe undergoing cleaning. U.S. Pat. Nos. 3,137,974 to Kirkland, 3,902,276 to Jarvis and 4,314,427 to Stolz teach spin-blast tools. Kirkland, for example, discloses a spin-blast tool of a type having a hollow tubular handle connected at one end to a blast-slurry supply pipe and at the opposite end to a spinning jet head. The blast-slurry supply pipe carries an abrasive material such as sand in a sand-air mixture at approximately 110 pounds of pressure. Under this pressure, jet head rotation will exceed 1,000 revolutions per minute, causing severe vibration and, ultimately, damage to the tool.

Centrifugal brakes have been provided to slow the rotation of the jet head of a spin-blast tool. However, it is not uncommon for brake linings to be in need of replacement after only four hours of use. Worn or defective brake linings will result in excessive rotational speed of the jet head. As a result, bearing members and other parts within the spin-blast tool wear prematurely.

The difficulties in providing a properly operating brake mechanism in a spin-blast tool result from the rigors associated with a tool which projects a pressurized sand-air mixture into a confined space. Moreover, it is important that a brake mechanism of a spin-blast tool restrain the rotational speed of the jet head but not so much as to diminish performance of the tool.

An object of the present invention is to provide a brake mechanism which is adjustable and which withstands the rigors of a spin-blast tool.

DISCLOSURE OF THE INVENTION

The above object has been met by a spin-blast tool having a braking mechanism which is not subject to frictional wear between brake parts and which provides a rotational velocity restraining force that may be easily adjusted. The braking mechanism includes first and second sets of magnets which interact to create a drag to inhibit rotation of a jet head.

The pipe spin-blast tool includes a handle member having an inflow end connected to a blast-slurry supply pipe and having an outflow end. An inner pipe is inserted into the handle member such that the inner pipe has a first portion positioned within the handle member in material transfer engagement with the inflow end and has a second portion extending outwardly from the handle member. Bearings are fixed to the handle member and support the inner pipe to permit rotation relative to the handle member. At the end of the inner tube opposite the handle member is positioned a jet head having a pair of nozzles for angularly directing a blast of sand-air mixture to produce a reaction force which rotates the inner pipe.

A stationary annular disc is fixedly mounted to the outflow end of the handle member coaxial to the inner pipe. The stationary disc has a first set of permanent magnets having parallel coinciding poles. A rotating annular disc is coaxially mounted on the inner pipe between the jet head and the stationary annular disc. The rotating disc has a second set of permanent magnets having poles oriented opposite the poles of the first set of permanent magnets. Both annular discs are made of a nonmagnetic material. The rotating disc has a tubular extension through which an externally threaded set screw penetrates to permit displacement of the rotating disc relative to the stationary disc.

An advantage of the present invention is that the magnetic attraction between the two sets of permanent magnets provides a drag as the rotating disc is turned relative to the stationary disc. Thus the discs provide a rotational velocity restraining force at all times without creating heat and wear resulting from frictional contact of parts as is normally found in the creation of such a force. Another advantage is that the rotating disc is axially movable along the inner pipe so that magnetic attraction or repulsion between the two sets of magnets may be varied to prevent an excessive force which would diminish performance of the tool. Still another advantage is that the discs are each made of a dielectric material, thereby insuring that the discs do not attract metallic particles within a pipeline undergoing cleaning.

BEST MODE FOR CARRYING OUT THE INVENTION

Figure 2:
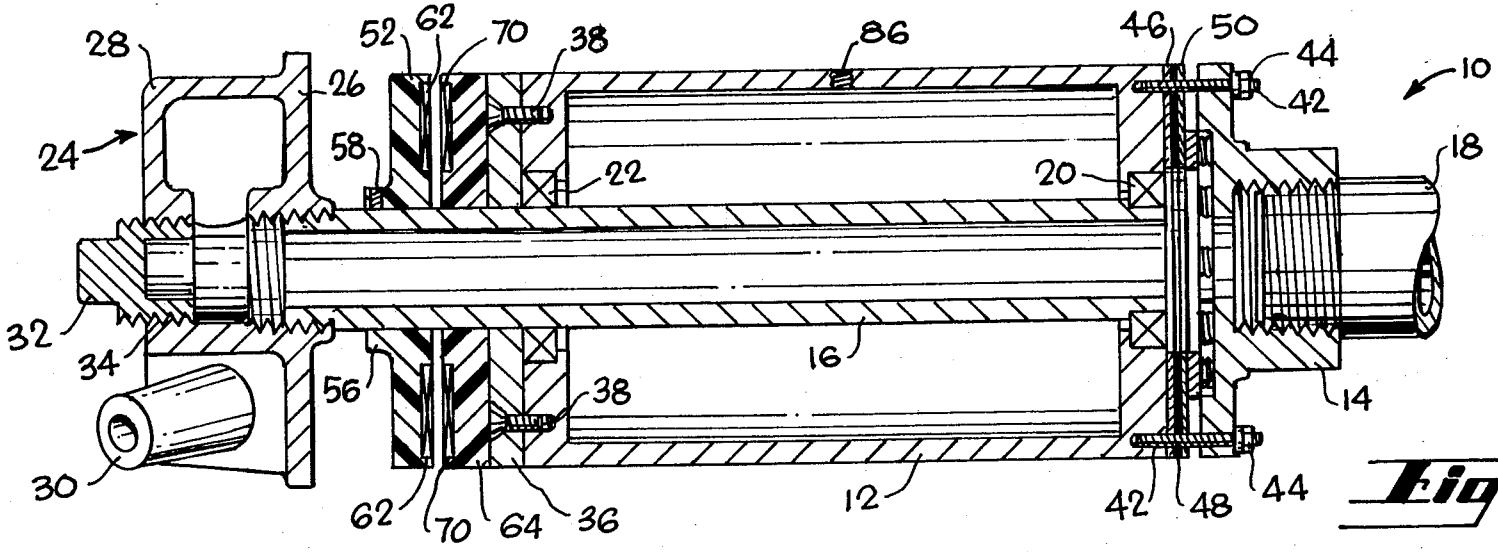
FIG. 2 is a side sectional view of the tool of FIG. 1.
Figure 1:
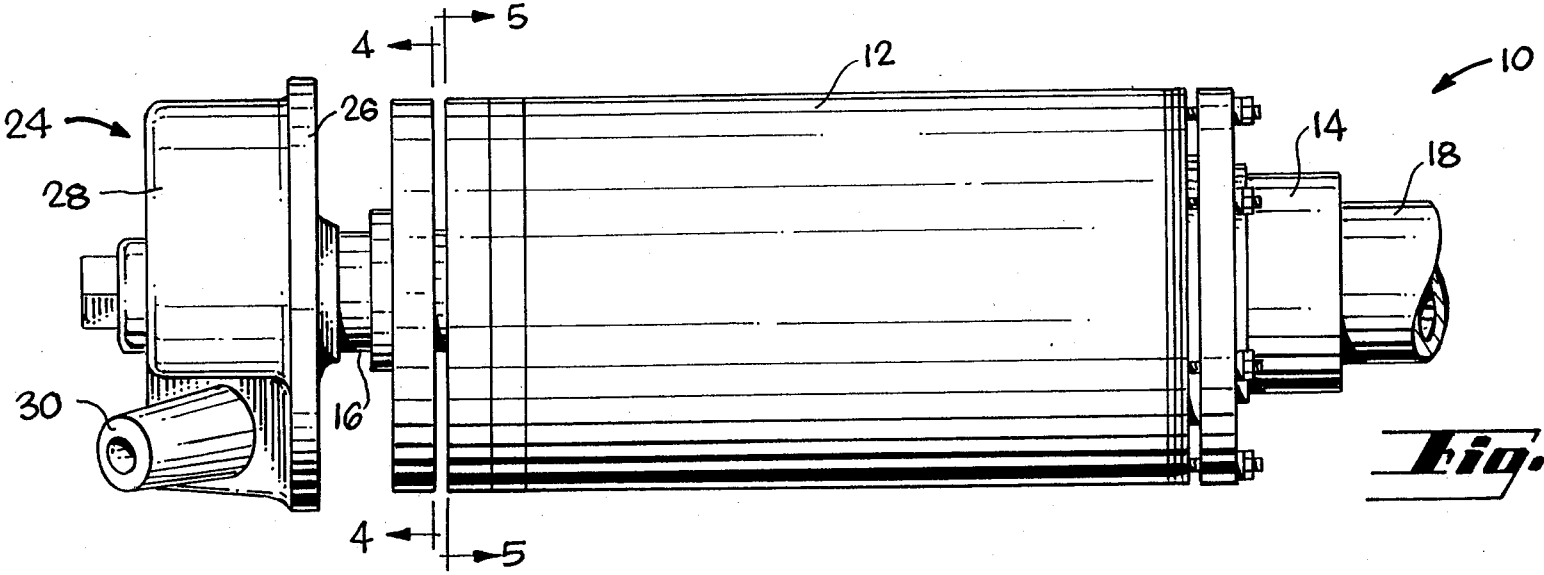
FIG. 1 is a side view of a spin-blast tool in accord with present invention.

With reference to FIGS. 1 and 2, a spin-blast tool 10 includes a tubular handle 12 having a flanged member 14 at an inflow end and having a coaxial inner pipe 16. A blast-slurry supply pipe 18 having an externally threaded end is attached to the internally threaded flanged member 14. Attachment of the blast-slurry supply pipe 18 places the inner pipe 16 in material transfer communication with a supply, not shown, of abrasive material such as sand combined with a pressurized gas. The inner pipe 16 is rotatably supported within the tubular handle 12 by a rearward bearing 20 and a forward bearing 22. The major portion of the inner pipe 16 is housed within the tubular handle 12, but a forward portion of the inner pipe extends outwardly from the tubular handle at the forward bearing 22.

A spinning jet head 24 has a base plate portion 26 which is threadedly coupled to the inner pipe 16. The jet head 24 includes a hollow body 28 to which is coupled a plurality of nozzles similar to nozzle 30. Normally, two nozzles 30 are provided on opposite sides of the jet head 24. Material progressing through the inner pipe 16 will exit from the spin-blast tool 10 through nozzles 30. The force of the spray from nozzles 30 creates a reaction force to spin the jet head 24 and the inner tube 16.

Typically, the inner pipe 16 has an inside radius of approximately 0.5 inches and an outside radius of 0.75 inches. The tubular handle 12 may have an inside radius of approximately 1.25 inches and an outside radius of approximately 1.5 inches. The rearward bearing 20 and the forward bearing 22 are each press fit in place. Each of the bearings has an inner race and an outer race, with ball bearings between races. A plug 32 is threadedly coupled at 34 to close the bore extending through the jet head 24.

Figure 3:
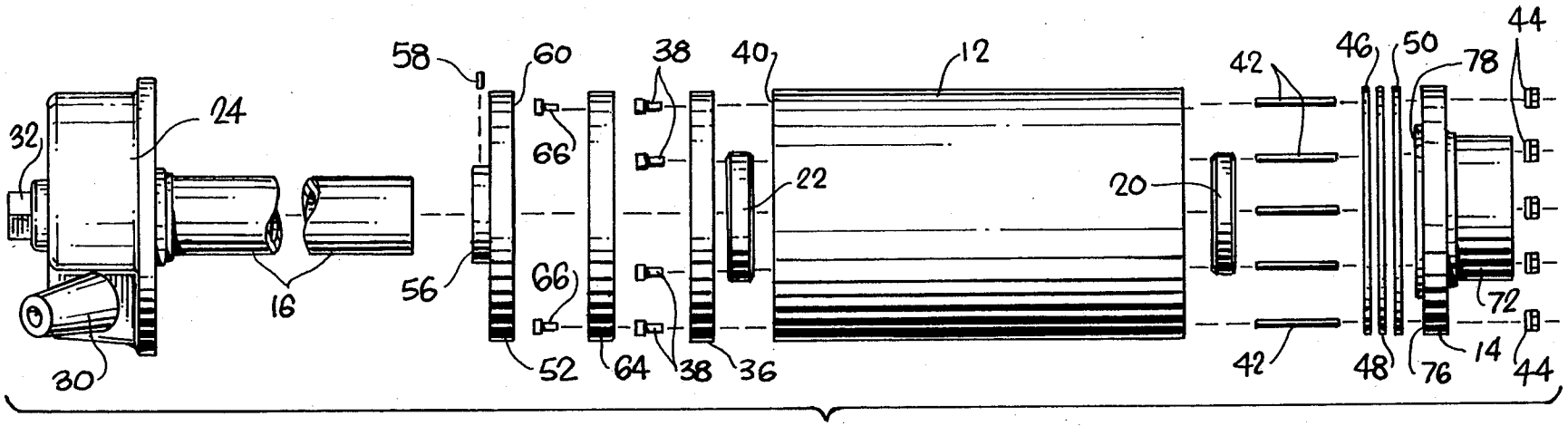
FIG. 3 is a side exploded view of the tool of FIG. 2.

Referring now to FIGS. 2 and 3, the forward bearing 22 is capped by a cover plate 36 having screws 38 which connect the over plate 36 to the outflow end 40 of the tubular handle 12. The cover plate 36 has a central aperture which permits passage of the inner pipe 16. The rearward bearing 20 is secured in place by the flange member 14. Externally threaded rods 42 are threadedly coupled to the tubular handle 12 and have a portion projecting from the tubular handle for penetration through aligned apertures in the flange member 14. Nuts 44 secure the flanged member 14 to the tubular housing. Additionally, pressure from the flange member 14 secures seals 46, 48 and 50 against the tubular handle 12. The forward seal 46 is made of cork while the center seal 48 is made of an elastomeric material and the rearwardmost seal 50 is made of leather.

Figure 4:
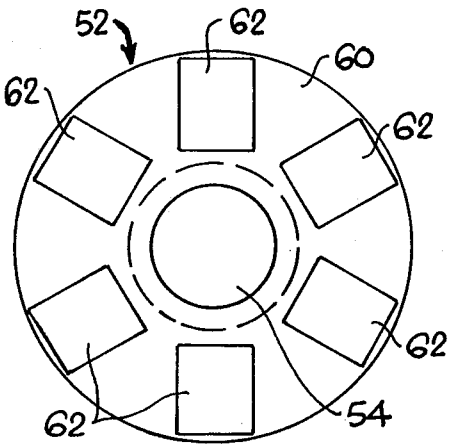
FIG. 4 is a rear view of a rotating disc taken along lines 4—4 of FIG. 1.

FIGS. 2 and 3 show a side view and FIG. 4 illustrates a front view of a nonmagnetic rotating disc 52 which is coaxially mounted to the inner pipe 16. The rotating disc 52 has an annular configuration and has a center aperture 54 for passage of the inner pipe 16. An extended sleeve at the forward end of the rotating disc 52 is penetrated by a set screw 58, thereby permitting displacement of the rotating disc relative to the tubular handle 12. The rearward surface 60 of the rotating disc 52 includes a plurality of cavities, each of which receives a permanent magnet 62. The magnets 62 are equidistantly spaced about the rotating disc 52 and have coinciding poles aligned parallel with the axis of the rotating disc 52. For example, the magnets 62 may be aligned so that each has a north pole flush with the rearward surface 60 of the rotating disc.

Figure 5:
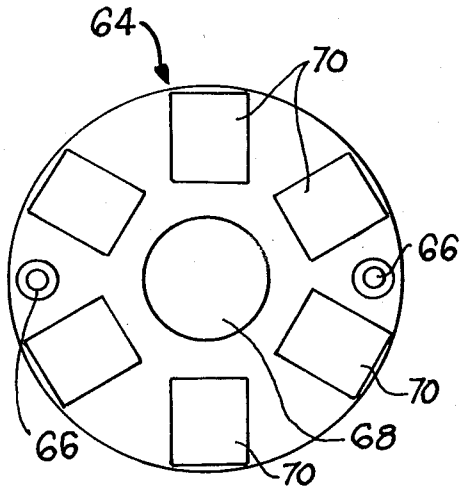
FIG. 5 is a front view of a stationary disc taken along lines 5—5 of FIG. 1.

Now referring to FIGS. 2, 3 and 5, a stationary nonmagnetic disc 64 is fixedly mounted to the tubular handle 12 by screws 66 which penetrate the cover plate 36. Like the rotating disc, the stationary disc 64 has an annular configuration and a center aperture 68 for passage of the inner pipe 16. Similarly, the stationary disc 64 has cavities which receive a plurality of permanent magnets 70. The magnets 70 are five in number and are spaced apart from adjacent magnets by 72°. The magnets associated with the stationary disc 64 have coinciding poles aligned parallel with the inner pipe 16 to create a magnetic flux in the direction of the rotating disc 52. Thus, as the rotating disc 52 is caused to revolve relative to the stationary disc 64, a drag is produced by the magnetic attraction. Optionally, the discs 52 and 64 may be made of a dielectric material to prevent interference with the production of magnetic drag and to insure that the discs do not attract metallic particles during operation of the spin-blast tool.

Figure 6:
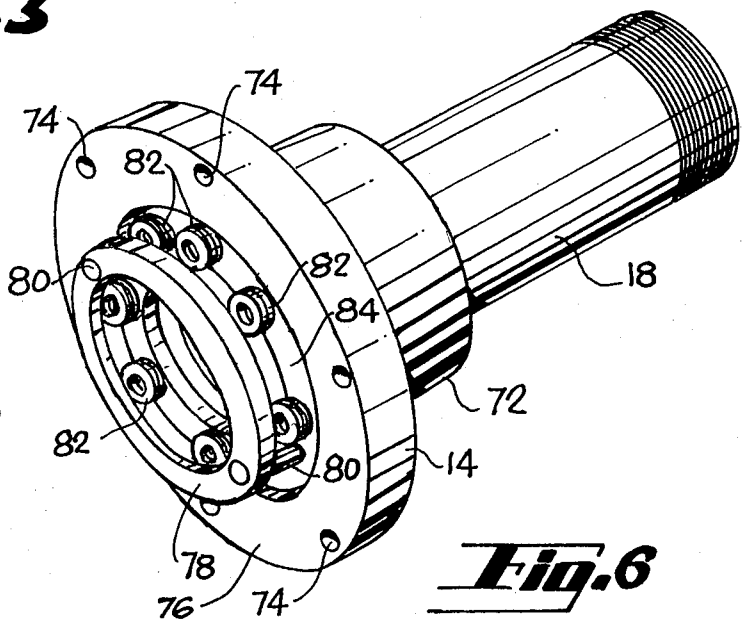
FIG. 6 is a perspective view of a flange utilizing attachment at the rear of the tool of FIG. 1

Turning now to FIGS. 3 and 6, the flanged member 14 is fitted to a blast-slurry supply pipe 18 by means of threads within a sleeved portion 72 of the flanged member. As noted above, the flanged member 14 includes screw holes 74 aligned to receive externally threaded rods 42. In this manner, the flanged member 14 may be secured to the tubular handle 12 by hexagonal nuts 44. The hexagonal nuts 44 may be tightened such that the forward surface 76 provides compression of the seals 46, 48 and 50. More importantly, however, a compression ring 78 is spring biased to exert a force radially inwardly of the outer circumference of the flange member 14. The compression ring 78 is slidably fit along rods 80 which align the compression ring for frictional contact with a plurality of helical spring members 82. With the flanged member 14 in an extracted condition, the helical springs 42 will push the compression ring 78 to an outermost extremity along the rods 80. As the flanged member 14 is tightened to the tubular handle 12, however, the helical springs 82 will be compressed and the compression ring 78 will recede into an annular groove 84 in the flange member. The helical springs 82 are fitted within apertures, not shown, as are the rods 80 so that the compression ring 78 may be brought to a position flush with the forward surface 76 of the flanged member. The seals 46, 48 and 50 serve to keep abrasive material from entering the tubular handle 12 and causing damage to the component parts inside the tubular handle.

Seal 50 is made of a pliable material which will absorb excess lubricant from the bearings, such as leather. The seal 50 serves to keep air out of the bearings. However, as the bearings rotate, the leather will be worn away. For this reason, the spring biased compression ring 78 pushes against the leather seal maintaining a tight relation relative to the bearings and keeping air out. The bearings allow rotation between the material transfer conduit and an outer coaxial tubular handle 12. At one end, near the head 24 sealed bearings 22 close the end of the handle, while at the opposite end, the leather seal 50, removably closes open or nonsealed bearings so that the bearings may be lubricated as the need rises.

The tubular handle 12 includes at least one lubrication screw 86 as seen in FIG. 2. The lubrication screw 86 must be secured during operation of the spinblast tool. The cover plate 36 includes a number of screw holes, not shown, for fastening of outwardly extending arms or other means for insuring axial movement of the spin-blast tool along a pipe undergoing cleaning. It is important that the jet head 24 does not make contact with a pipe to be cleaned.

In operation, the spin-blast tool is moved axially along the interior of a pipe such as the metal conduit of a gas pipeline. A combination of an abrasive material and a gas are supplied through blast-slurry supply pipe 18 to the inner pipe 16. Typically, the combination is an air-sand mixture. The mixture exits the inner pipe at the jet head 24, whereupon it is extruded through a pair of nozzles 30. The force of the air-sand mixture through nozzles 30 provide a reaction force which causes the jet head 24 and the inner pipe 16 to spin relative to the tubular handle 12. Left unchecked the rotational velocity of the jet head 24 and the inner pipe 16 would be excessive and would cause premature wear to components of the spin-blast tool. It has been discovered, however, that despite the extreme force associated with the spin-blast tool, the oppositely polarized permanent magnets 62 and 70 of the discs 52 and 64 will provide the rotational velocity restraining force needed to increase tool life. The permanent magnets 62 of the stationary disc 52 develop a magnetic field which attracts the oppositely polarized permanent magnets 70 of the rotating disc 64. When the magnets 62 are aligned with the magnets 70, the discs 52 and 64 are in a condition of maximum stability. The magnetic attraction creates drag which counteracts any force having a tendency to displace the discs 52 and 64 from a stable position. Thus, the magnets 62 and 70 act in the manner of a braking mechanism which is continually applied to limit the rotational velocity of the inner pipe 16. Drag can also be created by aligning the magnets so that the magnets 62 are repulsive to the magnets 70.

The interaction of the permanent magnets 62 and 70 upon each other, and therefore the drag, is determined by a number of factors such as the strength of the magnetic field produced by the magnets and by the distance between magnets. Consequently, drag can be affected by displacement of the rotating discs 52 relative to the stationary disc 64. The rotating disc 52 should be positioned along the inner pipe 16 so that sufficient drag is provided to protect the components of the spin-blast tool, but without diminishing performance of the tool. The rotating discs 52 may be repositioned along the inner pipe 16 by the loosening and tightening of the set screw 58 within the extended sleeve 56.

The present invention has been illustrated and explained to include discs 52 and 64 which are members separate from the other members of the spin-blast tool. It is understood, however, that the term "disc" includes an assembly in which the permanent magnets 62 are embedded in the jet head 24 or in which the magnets 70 are embedded in the tubular housing 12.

I claim:

1. A pine spin-blast tool comprising, a handle member having inflow and outflow ends, said inflow end having a connector means for attachment to a material supply, a material transfer conduit having at least a portion projecting outwardly from said outflow end in rotational relation with said handle member, said material transfer conduit in fluid communication with said inflow end and having a rotational axis, a jet head coaxially mounted to said material transfer conduit in spaced-apart relation to said handle member, said jet head having at least one nozzle means for directing a blast of material, thereby producing a reaction force for rotating said material transfer conduit, a first annular disc fixedly connected to said handle member coaxial to said material transfer conduit between said handle member and said jet head, said first annular disc having first means for developing a first magnetic flux, a second annular disc coaxially mounted on said material transfer conduit for rotation in conformity with said jet head, said second annular disc disposed between said jet head and said first annular disc in spaced apart relation to said first annular disc, said second annular disc having second means for developing a second magnetic flux, said second flux magnetically interacting with said first flux, thereby providing a drag to rotation of said material transfer conduit, wherein said first means for developing a magnetic flux is a plurality of ferromagnetic members equidistantly spaced about a surface of the first annular disc facing said second annular disc, and said second means of developing a magnetic flux is a plurality of ferromagnetic members equidistantly spaced about a surface of the second annular disc facing said first annular disc, said ferromagnetic members of said first and second annular discs each having coinciding poles of like polarity aligned parallel the rotational axis of said material transfer conduit.

2. The tool of claim 1 wherein said ferromagnetic members of each annular disc are five in number and are spaced apart from adjacent ferromagnetic members by 72 degrees.

3. A pipe spin-blast tool comprising, a tubular handle having inflow and outflow ends, means for connecting said inflow end to a supply of abrasive material and gas, an inner pipe having a first portion positioned within said tubular handle in material transfer relation with said inflow end, said inner pipe having a second portion extending beyond said outflow end, said inner pipe supported for rotation relative to said tubular handle to define a rotational axis, a stationary annular disc fixedly mounted to said outflow end of the tubular handle, said stationary disc having a central aperture disposed to permit passage of said inner pipe therethrough and having a first means for developing a first magnetic flux, a rotating annular disc attached to said second portion of the inner pipe adjacent said stationary disc opposite said tubular handle, said rotating disc having means for selectively displacing the rotating disc along said rotational axis and having a second means for developing a second magnetic flux, said second flux magnetically interacting with said first flux, wherein said first rotating disc has a coaxial tubular extension and wherein said means for selectively displacing the rotating disc includes an externally threaded set screw penetrating said tubular extension and a jet head fixed to said second portion of the inner pipe for rotation in conformity with rotation of said inner pipe and said rotating annular disc.

4. A pipe spin-blast tool comprising, a tubular handle having inflow and outflow ends, means for connecting said inflow end to a supply of abrasive material and gas, an inner pipe having a first portion positioned within said tubular handle in material transfer relation with said inflow end, said inner pipe having a second portion extending beyond said outflow end, said inner pipe supported for rotation relative to said tubular handle to define a rotational axis, a stationary annular disc fixedly mounted to said outflow end of the tubular handle, said stationary disc having a central aperture disposed to permit passage of said inner pipe therethrough and having a first means for developing a first magnetic flux, a rotating annular disc attached to said second portion of the inner pipe adjacent said stationary disc opposite said tubular handle, said rotating disc having means for selectively displacing the rotating disc along said rotational axis and having a second means for developing a second magnetic flux, said second flux magnetically interacting with said first flux, wherein said first means for developing a magnetic flux is a plurality of ferromagnetic members equidistantly spaced about a surface of the stationary disc facing said rotating disc and said second means for developing a magnetic flux is a plurality of ferromagnetic members equidistantly spaced about a surface of the rotating disc facing said stationary disc, said ferromagnetic members of said stationary and rotating discs each having coinciding poles of like polarity respectively extending parallel said rotational axis, and a jet head fixed to said second portion of the inner pipe for rotation in conformity with rotation of said inner pipe and said rotating annular disc.

5. A pipe spin-blast tool comprising, a handle member having an inflow end adapted to be fit to a supply of abrasive material and gas, said handle having an outflow end, a tubular inner pipe inserted into said handle means, said inner pipe having a first portion positioned within said handle member in material transfer engagement with said inflow end and having a second portion extending outwardly from said handle member, bearing means fixed to said handle member for supporting said inner pipe to permit rotation of said inner pipe relative to said handle member, a first annular disc fixedly mounted to said outflow end of said handle member coaxial to said inner pipe, said first disc having a first set of permanent magnets having coinciding poles aligned parallel with the axis of said inner pipe, a second annular disc coaxially mounted to said second portion of the inner pipe for rotation therewith, said second annular disc having a second set of permanent magnets having coinciding poles aligned parallel with the axis of said inner pipe, said poles of said second set of permanent magnets having an orientation retarding rotary motion of said second disc relative to said first disc, said second disc having means for axially displacing said second disc relative to said first disc, and a jet head fixed to said second portion of the inner pipe, said jet head having nozzle means for translating torque to said inner pipe, said second annular disc and said jet head attached to said second portion of the inner pipe for rotation at substantially identical rates.

6. The tool of claim 5 wherein said first and second discs are each made of a dielectric material.

7. The tool of claim 5 wherein at least a portion of said second disc has a coaxial tubular extension and said means for selectively displacing said second disc is an externally threaded set screw penetrating said tubular extension.

8. The tool of claim 5 wherein said first and second set of permanent magnets are each five in number.

9. The tool of claim 5 wherein said handle member coaxially encloses said inner pipe with bearing supports therebetween, said handle having sealed bearings at one end thereof and bearings open for lubricant flow at an opposite end, with a removable leather seal closing said open bearings, said leather seal having spring bias means for pushing said seal against said open bearings.

* * * * *